US008931300B2

(12) United States Patent
Smith et al.

(10) Patent No.: US 8,931,300 B2
(45) Date of Patent: Jan. 13, 2015

(54) MODULAR CABINET FOR ULTRA-LOW TEMPERATURE FREEZER

(75) Inventors: Dennis H. Smith, Dubuque, IA (US); Todd Swift, Weaverville, NC (US); Kevin D. Bramlett, Mars Hill, NC (US); Santosh Nerur, Asheville, NC (US); Walter Jeff Tipton, Asheville, NC (US); Wendell Morris, Asheville, NC (US)

(73) Assignee: Thermo Fisher Scientific (Asheville) LLC, Ashville, NC (US)

( * ) Notice: Subject to any disclaimer, the term of this patent is extended or adjusted under 35 U.S.C. 154(b) by 397 days.

(21) Appl. No.: 13/062,326

(22) PCT Filed: Sep. 30, 2009

(86) PCT No.: PCT/US2009/059016

§ 371 (c)(1),
(2), (4) Date: Jul. 14, 2011

(87) PCT Pub. No.: WO2010/039824

PCT Pub. Date: Apr. 8, 2010

(65) Prior Publication Data

US 2011/0259038 A1 Oct. 27, 2011

Related U.S. Application Data

(60) Provisional application No. 61/101,574, filed on Sep. 30, 2008.

(51) Int. Cl.

| | |
|---|---|
| ***F25D 11/02*** | (2006.01) |
| ***F25D 23/06*** | (2006.01) |
| *F25B 7/00* | (2006.01) |
| *F25B 39/02* | (2006.01) |

(52) U.S. Cl.

CPC ..... *F25D 23/062* (2013.01); *F25D 23/065* (2013.01); *F25B 7/00* (2013.01); *F25B 39/024* (2013.01)

USPC ..... 62/443

(58) Field of Classification Search

USPC ..... 62/246, 254, 298, 440, 444, 445, 446, 62/466, 516, 518; 312/108, 111, 116, 263, 312/265.1–265.5, 400, 401, 406, 406.2, 312/408; 220/4.28, 4.29, 592.02, 592.03, 220/592.05, 592.08, 592.09; 403/170, 171

See application file for complete search history.

(56) References Cited

U.S. PATENT DOCUMENTS 938,554 A * 11/1909 Carpenter ..... 62/256
1,327,473 A 1/1920 Hewitt (Continued)

FOREIGN PATENT DOCUMENTS

CH 677 272 A5 4/1991
CN 2874368 Y * 2/2007

(Continued)

OTHER PUBLICATIONS

Japanese Patent Office, Second Office Action, Application No. 2011-529383, mailed Mar. 10, 2014 (6 pages).

(Continued)

*Primary Examiner* — Melvin Jones

(74) *Attorney, Agent, or Firm* — Wood, Herron & Evans, LLP

(57) ABSTRACT

A storage cabinet (16) is provided for an ultra-low temperature freezer (10). The cabinet (16) includes a base platform (62*a*), a plurality of side structural insulated panels (45, 50, 55) each defining a side wall of the storage cabinet (16), and a plurality of generally vertically oriented posts (40) extending from the base platform (62*a*). Each of the plurality of vertically oriented posts (40) has a slot (40*a*) for receiving an edge portion (45*a*, 50*a*, 55*a*) of one of the insulated panels (45, 50, 55) therealong. The slot (40a) may have a generally U-shaped profile that surrounds the edge portion (45*a*, 50*a*, 55*a*) of one of the insulated panels (45, 50, 55). At least one of the generally vertically oriented posts (40) has a channel (40*c*) that extends along a longitudinal dimension thereof, the channel (40*c*) being configured to receive one of insulation, tubing, or wiring of the freezer therethrough.

31 Claims, 12 Drawing Sheets

(56) References Cited

U.S. PATENT DOCUMENTS

| | | | | |
|---|---|---|---|---|
| 1,328,324 | A | 1/1920 | Gwyer | |
| 1,398,964 | A | 12/1921 | Gwyer | |
| 1,452,272 | A | 4/1923 | Gwyer | |
| 1,724,882 | A * | 8/1929 | Meyercord et al. | 220/668 |
| 1,818,129 | A | 8/1931 | Grupe | |
| 1,933,242 | A | 10/1933 | Card et al. | |
| 2,502,581 | A * | 4/1950 | Morrison | 62/299 |
| 2,509,779 | A * | 5/1950 | Morrison | 62/451 |
| 2,818,192 | A * | 12/1957 | Weiner | 220/4.28 |
| 3,410,107 | A * | 11/1968 | Wallace et al. | 62/261 |
| 3,504,069 | A | 3/1970 | Borghi | |
| 4,210,252 | A * | 7/1980 | Cooke et al. | 220/4.28 |
| 4,535,600 | A * | 8/1985 | Gelbard | 62/156 |
| 4,953,362 | A | 9/1990 | Shoji et al. | |
| 5,291,752 | A | 3/1994 | Alvarez et al. | |
| 5,918,800 | A * | 7/1999 | Goshorn et al. | 229/199 |
| 6,050,330 | A * | 4/2000 | Schmit et al. | 165/133 |
| 6,397,620 | B1 | 6/2002 | Kelly et al. | |
| 6,438,983 | B1 * | 8/2002 | Zellner et al. | 62/246 |
| 6,796,623 | B1 * | 9/2004 | Fontana et al. | 312/265.4 |
| 6,804,976 | B1 * | 10/2004 | Dain | 62/525 |
| 2002/0172013 | A1 * | 11/2002 | Chandler | 361/724 |

FOREIGN PATENT DOCUMENTS

| | | | |
|---|---|---|---|
| DE | 1 229 554 | B | 12/1966 |
| EP | 1535543 | A1 | 6/2005 |
| FR | 807422 | A | 1/1937 |
| JP | 5656590 | U | 10/1954 |
| JP | 56134566 | U | 3/1955 |
| JP | 59152372 | U | 10/1984 |
| JP | 6065588 | U | 5/1985 |
| JP | 6240481 | U | 3/1987 |
| JP | 62-152175 | U | 9/1987 |
| JP | 5133678 | A | 5/1993 |
| JP | 11-15667 | U | 1/1999 |
| JP | 11142046 | A | 5/1999 |
| JP | 2005114194 | A | 4/2005 |
| JP | 2005156117 | A | 6/2005 |
| JP | 2005172306 | A | 6/2005 |
| JP | 2005345065 | A | 12/2005 |
| JP | 200678051 | A | 3/2006 |
| JP | 4155329 | B1 | 7/2008 |

OTHER PUBLICATIONS

European Patent Office, International Search Report and Written Opinion of the International Searching Authority, International Application No. PCT/US2009/059016, Dated Sep. 7, 2010 (14 pages).

Toshiba Corp., English Translation of Japanese Laid-Open Utility Model Application No. S62-40481, disclosure dated Mar. 11, 1987 (14 pages).

Espacenet, English Machine Translation of FR807422A, published on Jan. 12, 1937, retrieved from http://worldwide.espacenet.com/publicationDetails on Aug. 15, 2013 (5 pages).

Japanese Patent Office, English Translation of Patent Abstracts of Japan, Japanese Publication No. 05133678A, published on May 28, 1993 (1 page).

Searching PAJ, English Translation of Patent Abstracts of Japan, Japanese Publication No. 11-142046, published on May 28, 1999, retrieved on Aug. 1, 2013 from http://www19.ipdl.inpit.go.jp (1 page).

Japanese Patent Office, English Translation of Patent Abstracts of Japan, Japanese Publication No. 2005114194A, published on Apr. 28, 2005 (1 page).

Searching PAJ, English Translation of Patent Abstracts of Japan, Japanese Publication No. 2005-156117, published on Jun. 16, 2005, retrieved on Aug. 1, 2013 from http://www19.ipdl.inpit.go.jp (1 page).

Japanese Patent Office, English Translation of Patent Abstracts of Japan, Japanese Publication No. 2005172306A, published on Jun. 30, 2005 (1 page).

Japanese Patent Office, English Translation of Patent Abstracts of Japan, Japanese Publication No. 2005345065A, published on Dec. 15, 2005 (1 page).

Searching PAJ, English Translation of Patent Abstracts of Japan, Japanese Publication No. 2006-078051, published on Mar. 23, 2006, retrieved on Aug. 1, 2013 from http://www19.ipdl.inpit.go.jp (1 page).

Japanese Patent Office, English Translation of Patent Abstracts of Japan, Japanese Publication No. 2008282124A, published on Nov. 20, 2008 (1 page).

Japanese Patent Office, English Translation of Notice of Reasons for Rejection, Japanese Application No. 2011-529383, mailed on Jun. 25, 2013 (7 pages).

* cited by examiner

MODULAR CABINET FOR ULTRA-LOW TEMPERATURE FREEZER

CROSS-REFERENCE TO RELATED APPLICATION

This application is a submission under 35 U.S.C. §371 of International Application No. PCT/US2009/059016, filed Sep. 30, 2009, and claims the filing benefit of U.S. Provisional Patent Application Ser. No. 61/101,574 filed Sep. 30, 2008, the disclosures of which are hereby expressly incorporated by reference herein in their entireties.

FIELD OF THE INVENTION

The present invention relates generally to ultra-low temperature freezers and, more particularly, to the construction of a modular storage cabinet for an ultra-low temperature freezer.

BACKGROUND OF THE INVENTION

There has been a rapid increase in demand for refrigeration systems that can attain a very low temperature range. One type of system that can reach such temperatures is known as an ultra-low temperature freezer ("ULT"), which can maintain a very low range of temperatures. The ULT can be used to store and protect a variety of objects including critical biological samples, for example, so that they are safely and securely stored at a desired temperature for extended periods of time within a storage cabinet or compartment of the ULT. However, with the low storage temperatures involved, and the need to periodically insert and remove particular samples from the interior of the storage cabinet, various problems may arise.

Generally, in refrigeration systems, a refrigerant gas is compressed in a compressor unit. Heat generated by the compression is then removed generally by passing the compressed gas through a water or air cooled condenser coil. The cooled, condensed gas, is then allowed to rapidly expand into an evaporating coil that is in fluid communication with a refrigerator or freezer compartment where the gas becomes much colder, thus cooling the coil and the compartment of the refrigeration system or freezer with which the coil fluidly communicates.

Ultra-low and cryogenic temperatures ranging from approximately −95° C. to −150° C. have been achieved in refrigeration systems. An example of an ultra-low temperature freezer capable of reaching such temperatures is shown in U.S. Pat. No. 6,397,620 entitled Ultra-low Temperature Freezer Cabinet Utilizing Vacuum Insulated Panels, which is hereby expressly incorporated herein by reference in its entirety.

A method for constructing conventional ULT's may include forming an outer sheet metal cabinet and an inner metal cabinet and then applying expanded urethane foam to join the outer and inner cabinets to one another. This process is time consuming, messy and has inherent variation. For example, the two sheet metal cabinets may have to be placed in a large foaming fixture and urethane foam may be sprayed between the two cabinets. The foam is then allowed to cure, with typical required curing times being in the range of about 4 to about 48 hours, depending on the sizes and shapes of the two cabinets. The urethane foam provides insulation to the freezer.

There is a need, therefore, for construction methods and structures that address the problems and inefficiencies of conventional ULT's and conventional construction methods for producing such freezers and which can still provide support for the low temperatures achieved by the ULT.

SUMMARY OF THE INVENTION

The present invention overcomes the foregoing and other shortcomings of construction of ultra-low temperature freezers. While the invention will be described in connection with certain embodiments, it will be understood that the invention is not limited to these embodiments. On the contrary, the invention includes all alternatives, modifications and equivalents as may be included within the spirit and scope of the present invention.

In one embodiment, a storage cabinet is provided for an ultra-low temperature freezer. The cabinet includes a base platform, a plurality of side structural insulated panels, each defining a side wall of the storage cabinet, and a plurality of generally vertically oriented posts extending from the base platform. At least one of the plurality of generally vertically oriented posts has a slot for receiving an edge portion of one of the insulated panels therealong. The slot may have a generally U-shaped profile that surrounds the edge portion of one of the insulated panels. The channel may be configured to receive one of insulation, tubing, or wiring of the freezer therethrough. An outer skin may surround the insulated panels and define an outer surface of the freezer, with the volume between the outer skin and the insulated panels being effectively free of expanding, foamed-in-place insulation.

In a specific embodiment, the cabinet includes a roll-bond evaporator adjacent one of the insulated panels and configured to fluidly communicate with a refrigeration system of the freezer for cooling an interior of the storage cabinet. The roll-bond evaporator may be coupled to one or more of the generally vertically oriented posts. A volume between the roll-bond evaporator and the adjacent side insulated panel may be effectively free of expanding, foamed-in place insulation. Alternatively, or additionally, the roll-bond evaporator may include a plurality of evaporator panels, with each evaporator panel being oriented generally parallel to one of the insulated panels. In a specific embodiment, the storage cabinet includes a plurality of roll-bond evaporator panels, each adjacent one of the insulated panels, and a plurality of capillary tubes, with each of the capillary tubes being in fluid communication with one of the roll-bond evaporator panels. In this embodiment, each of the capillary tubes is configured to fluidly communicate with a refrigeration system of the freezer for cooling the interior of the storage cabinet. Respective volumes between the roll-bond evaporator panels and the respectively adjacent side insulated panels may be effectively free of expanding, foamed-in place insulation.

In another specific embodiment, the cabinet includes an evaporator coil that is secured to one of the generally vertically oriented posts, with the evaporator coil being configured to fluidly communicate with a refrigeration system of the freezer for cooling an interior of the storage cabinet. In this specific embodiment, a spacer element is disposed between the evaporator coil and the one of the generally vertically oriented posts. Respective volumes between side wall portions of the evaporator coil and the respectively adjacent side insulated panels may be effectively free of expanding, foamed-in place insulation.

The cabinet may additionally, or alternatively, have a plurality of generally horizontally oriented frame members coupled to one or more of the generally vertically oriented posts, and a top structural insulated panel that extends between the generally horizontally oriented frame members.

One or more of the generally horizontally oriented frame members may include a resilient flap that is configured to urge the top insulated panel in a direction toward one of the side structural insulated panels so as to secure the top and side structural insulated panels relative to one another without the use of fasteners.

In a specific embodiment, at least one of the generally vertically oriented posts has a channel that extends along a longitudinal dimension thereof. The cabinet includes a plurality of T-shaped brackets that respectively define a plurality of corners of the cabinet, with at least one of the T-shaped brackets having a leg that is shaped for insertion into the channel of one of the at least one of the generally vertically oriented posts. One or more of the T-shaped brackets may be such that at least the leg thereof is made of a flexible material that is configured to bend during insertion of the leg into the channel of one of the generally vertically oriented posts.

The cabinet may include a plurality of T-shaped brackets respectively defining a plurality of corners of the cabinet, with at least one of the T-shaped brackets having a generally vertically oriented leg for coupling with one of the generally vertically oriented posts, and a pair of generally horizontal arms each configured for coupling with one of a plurality of generally horizontally oriented frame members.

In another embodiment, an ultra-low temperature freezer is provided. The freezer includes a deck that supports a refrigeration system therein, and a storage cabinet that is supported above the deck. The cabinet has an interior that is cooled by the refrigeration system. The cabinet includes a plurality of side structural insulated panels, each defining a side wall of the storage cabinet, and a plurality of generally vertically oriented posts that extend from the deck. At least one of the generally vertically oriented posts has a slot for receiving an edge portion of one of the panels therealong. The refrigeration system may, for example, be a two-stage cascade refrigeration system that includes a heat exchanger that is supported within the deck. The storage cabinet may include an outer skin surrounding the insulated panels and defining an outer surface of the freezer, with the volume between the outer skin and the insulated panels being effectively free of expanding, foamed-in-place insulation.

In another embodiment, a method is provided for constructing an ultra-low temperature freezer. The method includes obtaining a base platform and arranging a plurality of side structural insulated panels so as to define respective side walls of a storage cabinet of the freezer. The method includes supporting a plurality of generally vertically oriented posts with the base platform, and receiving an edge portion of one of the panels within a slot of one of the generally vertically oriented posts. The method may include receiving one of insulation, tubing, or wiring of the freezer into a channel that extends along a longitudinal dimension of one of the generally vertically oriented posts.

The method may include placing a roll-bond evaporator adjacent one of the panels, and placing the roll bond evaporator in fluid communication with a refrigeration system of the freezer. The method may, alternatively or additionally, include disposing an outer skin around the insulated panels to thereby define an outer surface of the freezer, and leaving the volume between the outer skin and the insulated panels effectively free of expandable, foamed-in-place insulation. The method may also include obtaining a top insulated panel as well as a generally horizontally oriented bar having a resilient portion, and arranging the top and side structural insulated panels such that the resilient portion urges the top insulated panel in a direction toward one of the side structural insulated panels. The urging is operable to secure the top and side structural insulated panels relative to one another without the use of fasteners.

The method may include obtaining a bracket and bending a leg of the bracket to facilitate insertion thereof into a channel extending along a longitudinal dimension of one of the generally vertically oriented posts. Additionally, or alternatively, the method may include coupling the bracket to one of the generally vertically oriented posts and to a pair of generally horizontally oriented frame members to thereby define a corner of the freezer.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE INVENTION

Figure 1:
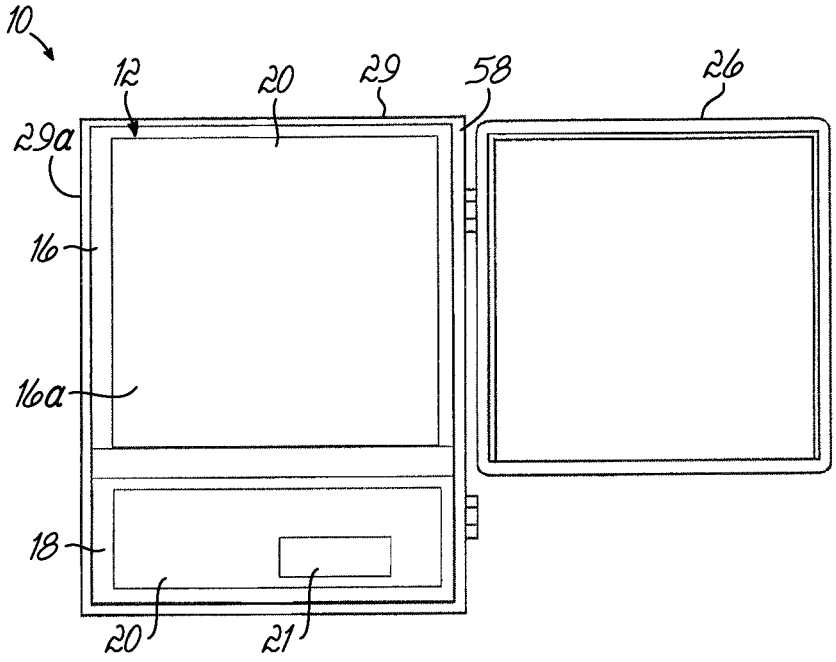
FIG. 1 is a front view illustrating an exemplary ultra-low temperature freezer ("ULT") in accordance with one embodiment of the present invention.

The invention will now be described with reference to the figures, in which like reference numerals refer to like parts throughout.

With reference to the figures and particularly to FIG. 1, an ultra-low temperature freezer ("ULT") 10 is illustrated in accordance with one embodiment of the present invention. The ULT 10 includes a housing or framework 12 that includes a storage cabinet or compartment 16 supported above a deck 18. The deck 18, in turn, supports one or more components of a refrigeration system 20 (schematically depicted) that is configured to cool the interior 16*a* of cabinet 16. In this regard, the deck 18 may support one or more compressors of a single refrigerant system or one or more compressors of a two-stage cascade refrigeration system, for example. The system 20 may, for example, include a heat exchanger 21 (schematically depicted) that is supported within the deck 18 and which ultimately fluidly communicates with an evaporator of the system 20, explained in further detail below. Exemplary refrigeration systems and components thereof suitable with the present invention are described, for example, in co-assigned U.S. patent application Ser. Nos. 12/570,348 and 12/570,480 , filed concurrently with the present application, and respectively entitled "Refrigeration System Having A Variable Speed Compressor" and "Refrigeration System Mounted With A Deck." The respective disclosures of each of these U.S. Patent Applications are hereby expressly incorporated herein by reference in their entireties.

Figure 1A:
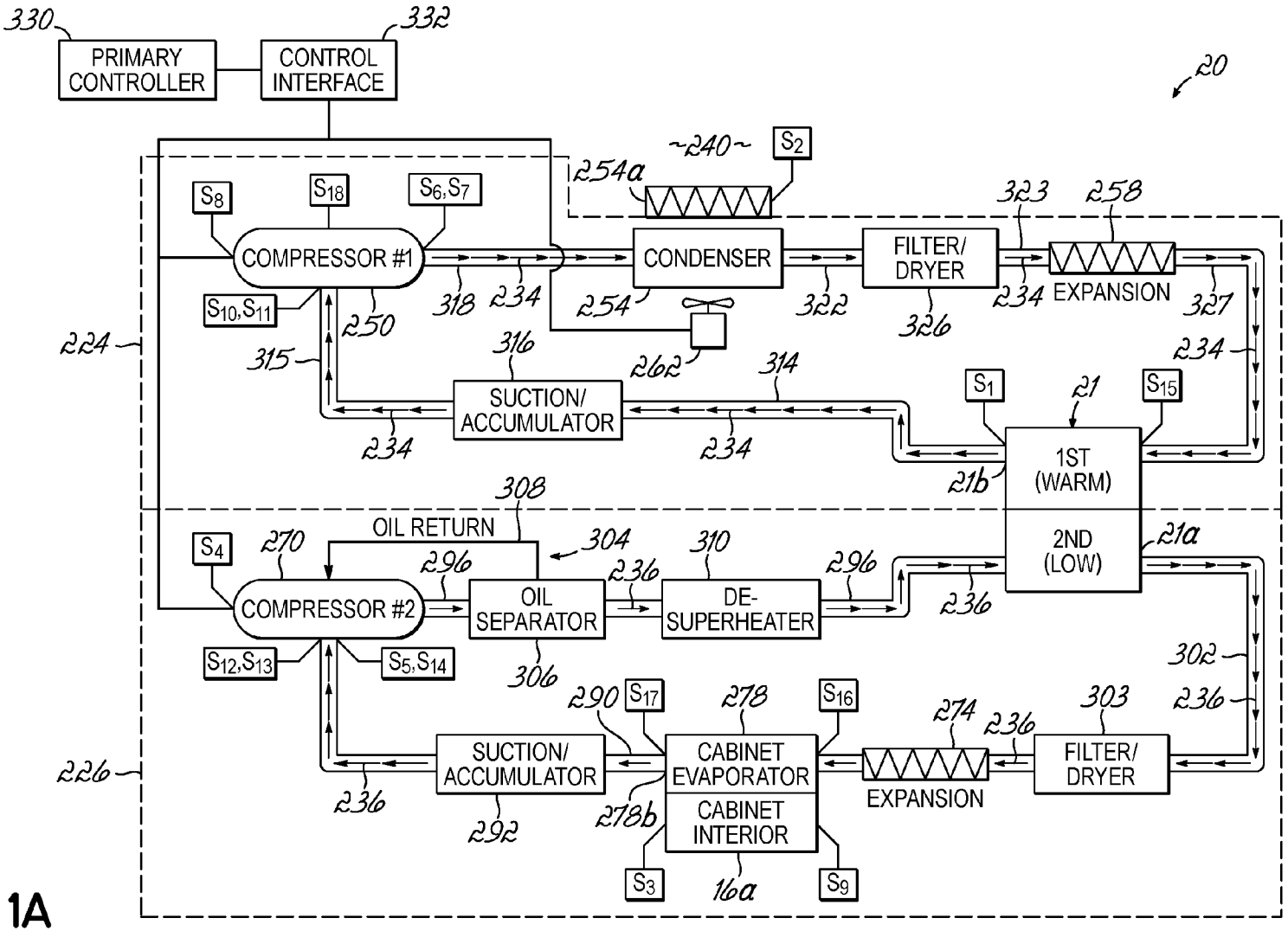
FIG. 1A is schematic representation of a refrigeration system of the ULT of FIG. 1.

With reference to FIG. 1A, details of an exemplary refrigeration system 20 are illustrated. System 20 is made up of a first stage 224 and a second stage 226 respectively defining first and second circuits for circulating a first refrigerant 234 and a second refrigerant 236. A plurality of sensors $S_1$ through $S_{18}$ are arranged to sense different conditions of system 20 and/or properties of the refrigerants 234, 236 in system 20, while a controller 330 accessible through a controller interface 332, permit controlling of the operation of system 20. The first stage 224 transfers energy (i.e., heat) from the first refrigerant 234 to the surrounding environment 240, while the second refrigerant 236 of the second stage 226 receives energy from the cabinet interior 16*a*. Heat is transferred from the second refrigerant 236 to the first refrigerant 234 through the heat exchanger 21 (FIG. 1) that is in fluid communication with the first and second stages 224, 226 of the refrigeration system 20.

The first stage 224 includes, in sequence, a first compressor 250, a condenser 254, and a first expansion device 258. A fan 262 directs ambient air across the condenser 254 through a filter 254*a* and facilitates the transfer of heat from the first refrigerant 234 to the surrounding environment 240. The second stage 226 includes, also in sequence, a second compressor 270, a second expansion device 274, and an evaporator 278. The evaporator 278 is in thermal communication with the interior 16*a* of cabinet 16 (FIG. 1) such that heat is transferred from the interior 16*a* to the evaporator 278, thereby cooling the interior 16*a*. The heat exchanger 21 is in fluid communication with the first stage 224 between the first expansion device 258 and the first compressor 250. Further, the heat exchanger 21 is in fluid communication with the second stage 226 between the second compressor 270 and the second expansion device 274. In general, the first refrigerant 234 is condensed in the condenser 254 and remains in liquid phase until it evaporates at some point within the heat exchanger 21. First refrigerant vapor is compressed by first compressor 250 before being returned to condenser 254.

In operation, the second refrigerant 236 receives heat from the interior 16*a* through the evaporator 278 and flows from the evaporator 278 to the second compressor 270 through a conduit 290. An accumulator device 292 is in fluid communication with conduit 290 to pass the second refrigerant 236 in gaseous form to the second compressor 270, while accumulating excessive amounts of the same in liquid form and feeding it to the second compressor 270 at a controlled rate. From the second compressor 270, the compressed second refrigerant 236 flows through a conduit 296 and into the heat exchanger 21 thermally communicating the first and second stages 224, 226 with one another. The second refrigerant 236 enters the heat exchanger 21 in gas form and transfers heat to the first refrigerant 234 while condensing into a liquid form. In this regard, the flow of the first refrigerant 234 may, for example, be counter-flow relative to the second refrigerant 236, so as to maximize the rate of heat transfer. In one specific, non-limiting example, the heat exchanger 21 is in the form of a split-flow brazed plate heat exchanger, vertically oriented within the deck 18 (FIG. 1), and designed to maximize the amount of turbulent flow of the first and second refrigerants 234, 236 within heat exchanger 21, which in turn maximizes the heat transfer from the second refrigerant 236 to the first refrigerant 234. Other types or configurations of heat exchangers are possible as well.

With continued reference to FIG. 1A, the second refrigerant 236 exits the heat exchanger 21, in liquid form, through an outlet 21*a* thereof and flows through a conduit 302, through a filter/dryer unit 303, then through the second expansion device 274, and then back to the evaporator 278 of the second stage 226 where it can evaporate into gaseous form while absorbing heat from the cabinet interior 16*a*. The second stage 226 of this exemplary embodiment also includes an oil loop 304 for lubricating the second compressor 270. Specifically, the oil loop 304 includes an oil separator 306 in fluid communication with conduit 296 and an oil return line 308 directing oil back into second compressor 270. Additionally, or alternatively, the second stage 226 may include a de-superheater device 310 to cool down the discharge stream of the second refrigerant 236 and which is in fluid communication with conduit 296 upstream of the heat exchanger 21.

As discussed above, the first refrigerant 234 flows through the first stage 224. Specifically, the first refrigerant 234 receives heat from the second refrigerant 36 flowing through the heat exchanger 21, leaves the heat exchanger 21 in gas form through an outlet 21 b thereof and flows along a pair of conduits 314, 315 towards the first compressor 250. An accumulator device 316 is positioned between conduits 314 and 315 to pass the first refrigerant 234 in gaseous form to the first compressor 250, while accumulating excessive amounts of the same in liquid form and feeding it to the first compressor 250 at a controlled rate. From the first compressor 250, the compressed first refrigerant 234 flows through a conduit 318 and into the condenser 254. The first refrigerant 234 in condenser 254 transfers heat to the surrounding environment 240 as it condenses from gaseous to liquid form, before flowing along conduits 322, 323, through a filter/dryer unit 326, and into the first expansion device 258 , where the first refrigerant 234 undergoes a pressure drop. From the first expansion device 258, the first refrigerant 234 flows though a conduit 327 back into the heat exchanger 21, entering the same in liquid form.

The interior 16*a* of cabinet 16 is configured to contain, cool and maintain at a desired low temperature (e.g., from about −80° C. to about −160° C. or from about −95° C. to about −150° C., for example) biological laboratory samples or other items. The storage cabinet 16 may be subdivided into a plurality of compartments (not shown) or it may alternatively have a single compartment. The freezer 10 also includes a door 26 that is coupled to the housing 12 and which provides access to the interior 16*a* of cabinet 16. An outer skin 29 surrounds the housing 12 and defines an outer surface 29*a* of the freezer 10. Specifically, in the illustrated embodiment, the skin 29 surrounds the cabinet 16 and deck 18, although it may alternatively surround only one of these components.

Figure 2:
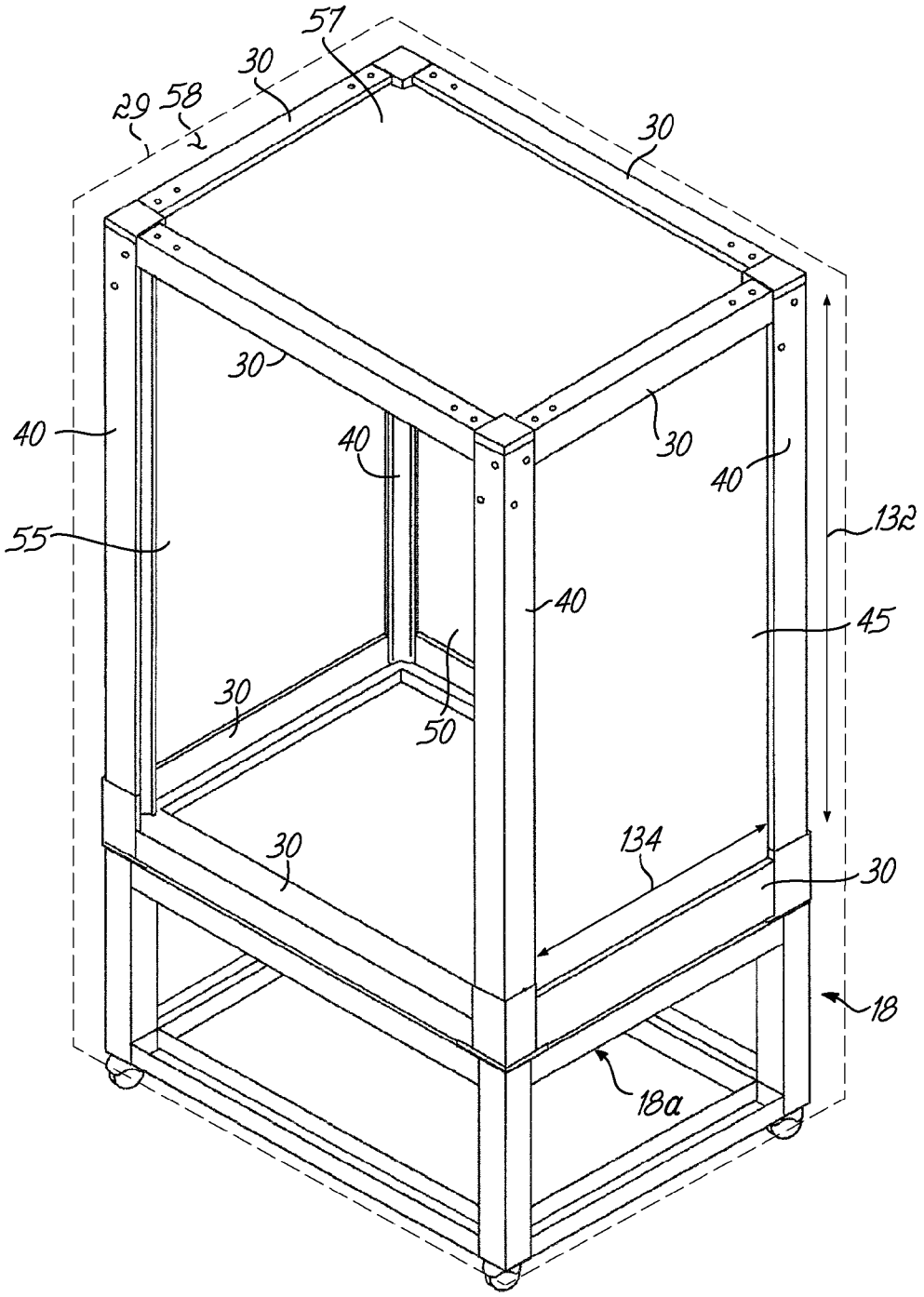
FIG. 2 is a perspective view of a housing or framework of the ULT of FIG. 1.
Figure 3:
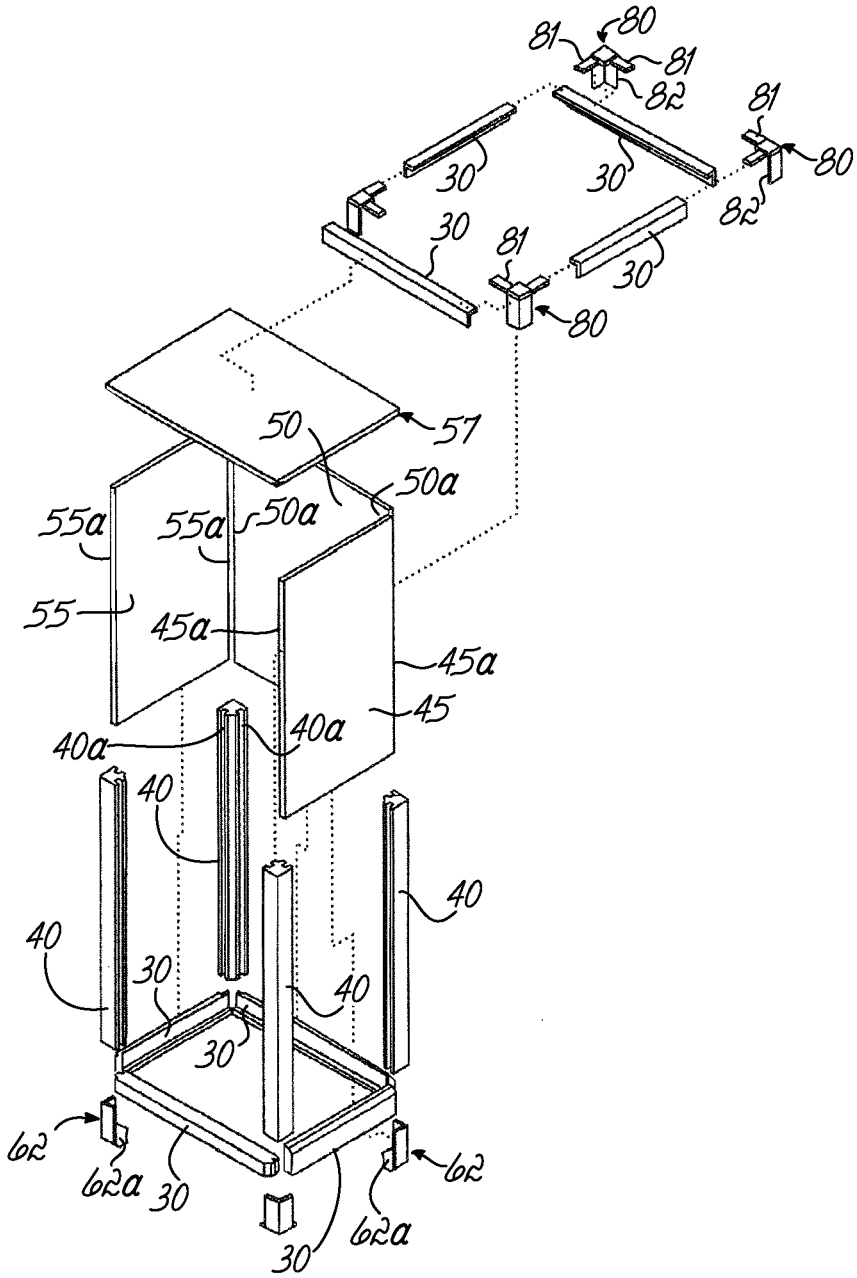
FIG. 3 is a perspective, exploded view of a storage cabinet of the housing of FIG. 2.
Figure 4:
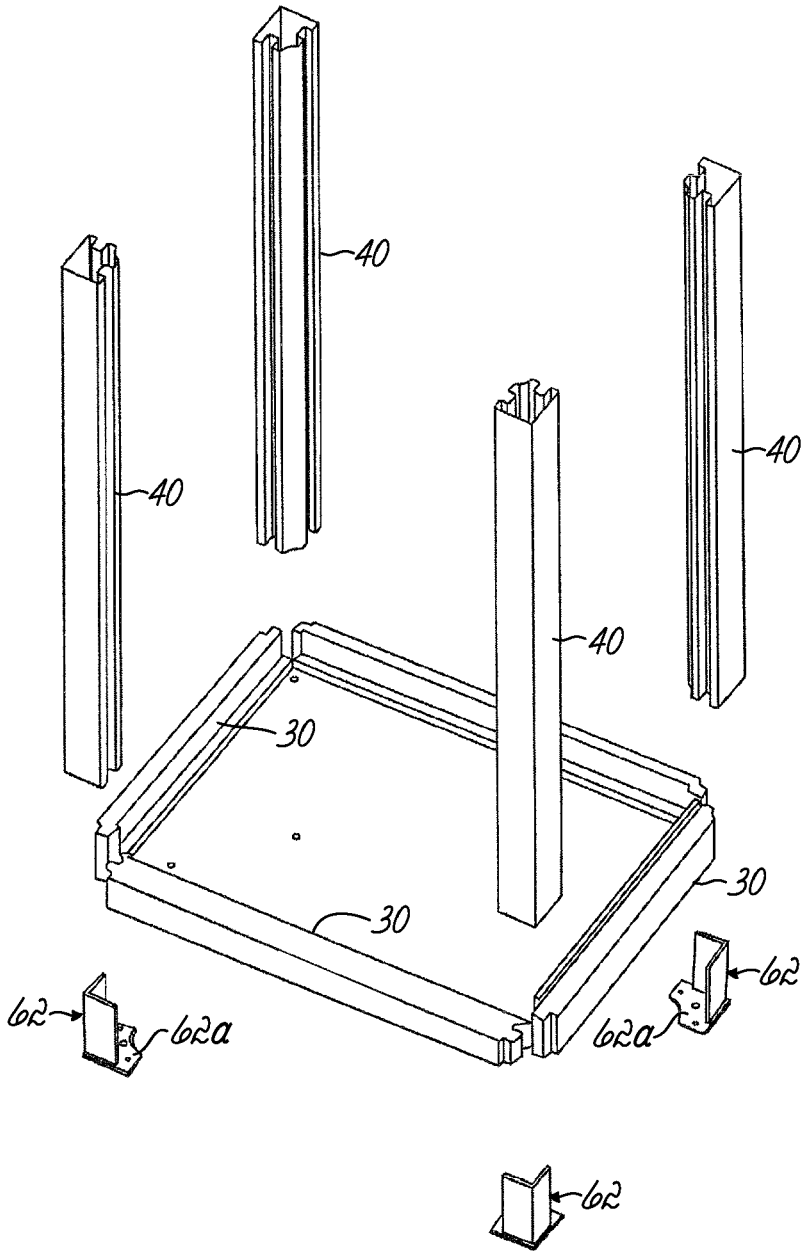
FIG. 4 is another perspective, exploded view, of a portion of the storage cabinet of FIGS. 3 and 4.

With reference to FIGS. 2 and 3, an exemplary construction of cabinet 16 is illustrated. Cabinet 16 includes a plurality of generally horizontally oriented frame members 30 and a plurality of generally vertically oriented supports or posts 40 which, in conjunction with a plurality of high performance structural insulated panels, define the housing 12 as explained in further detail below. The frame members 30 and posts 40 are made of one or more suitably chosen materials. For example, and without limitation, one or more of the frame members 30 and/or posts 40 can be made of a plastic material or from any other material, so long as they provide structural integrity and insulation to the cabinet 16. In the illustrated embodiment, cabinet 16 includes a plurality of side structural insulated panels 45, 50, 55 supported between the posts 40 and which provide structural integrity and insulation to the interior 16*a* of cabinet 16, as explained in further detail below. Additionally or alternatively, cabinet 16 may include a top insulated panel 57 made of materials similar to or different from the materials making up the side insulated panels 45, 50, 55, and which is supported between an upper set of the frame members 30. The side structural insulated panels 45, 50, 55 may, for example, be in the form of high performance vacuum insulated panels having a thickness of about 1 inch. Those of ordinary skill in the art will readily appreciate that the side structural insulated panels 45, 50, 55 can alternatively be made of any other suitably chosen insulation material, including foam, for example, or any other material having insulating properties.

Each of the side structural insulated panels 45, 50, 55 defines a side wall of the cabinet 16. Notably, the construction of cabinet 16 is such that a volume 58 between the outer skin 29 and the side structural insulated panels 45, 50, 55 is effectively free of expanding, foamed-in-place insulation (e.g., expanding, foamed-in-place foam). The effective absence of such foamed-in-place insulation simplifies and shortens the required time for manufacturing of the cabinet 16 and of freezer 10, generally.

With continued reference to FIGS. 2 and 3, the effective absence of foamed-in-place insulation in volume 58 is facilitated, in part, by the structural relationship between the side structural insulated panels 45, 50, 55 and the posts 40. More specifically, each of the posts 40 has a pair of slots 40*a* extending along the length thereof and which receives an edge portion 45*a*, 50*a*, 55*a* of two adjacent ones of the insulated panels 45, 50, 55. The slots 40*a* are suitably shaped to optimize the insulating capability of the cabinet 16 at the juncture between side walls of the cabinet 16. Specifically, the slots 40*a* of the illustrated embodiment are generally U-shaped and designed to maximize the path that air would have to travel from the exterior of the freezer 10 into the interior 16*a* of cabinet 16. Construction of the cabinet 16 may involve, for example, sliding the panels into the slots 40*a* of the posts 40.

Figure 5:
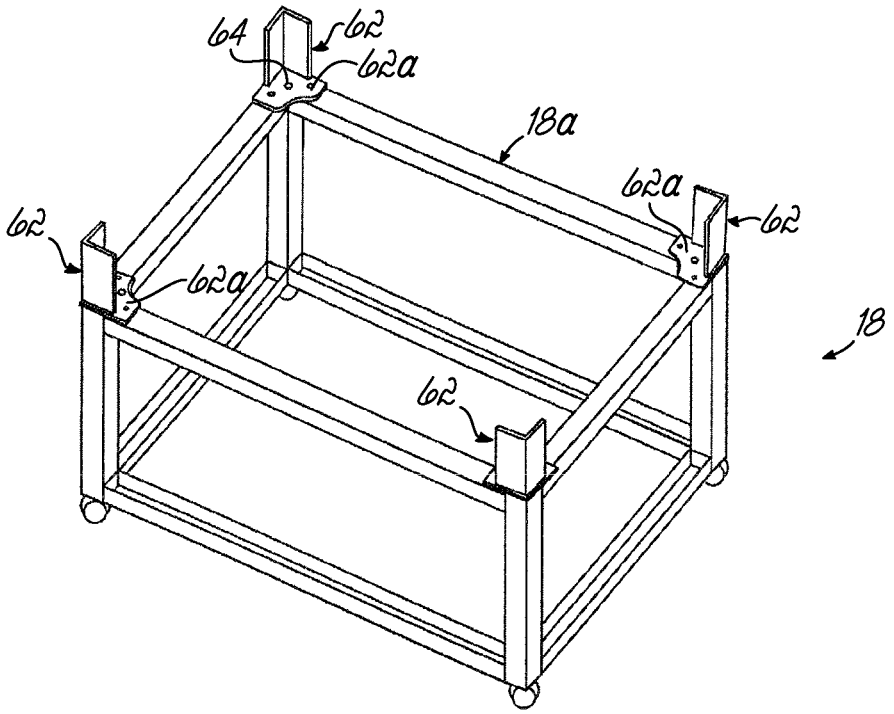
FIG. 5 is a perspective view of a deck of the housing of FIG. 2.
Figure 6:
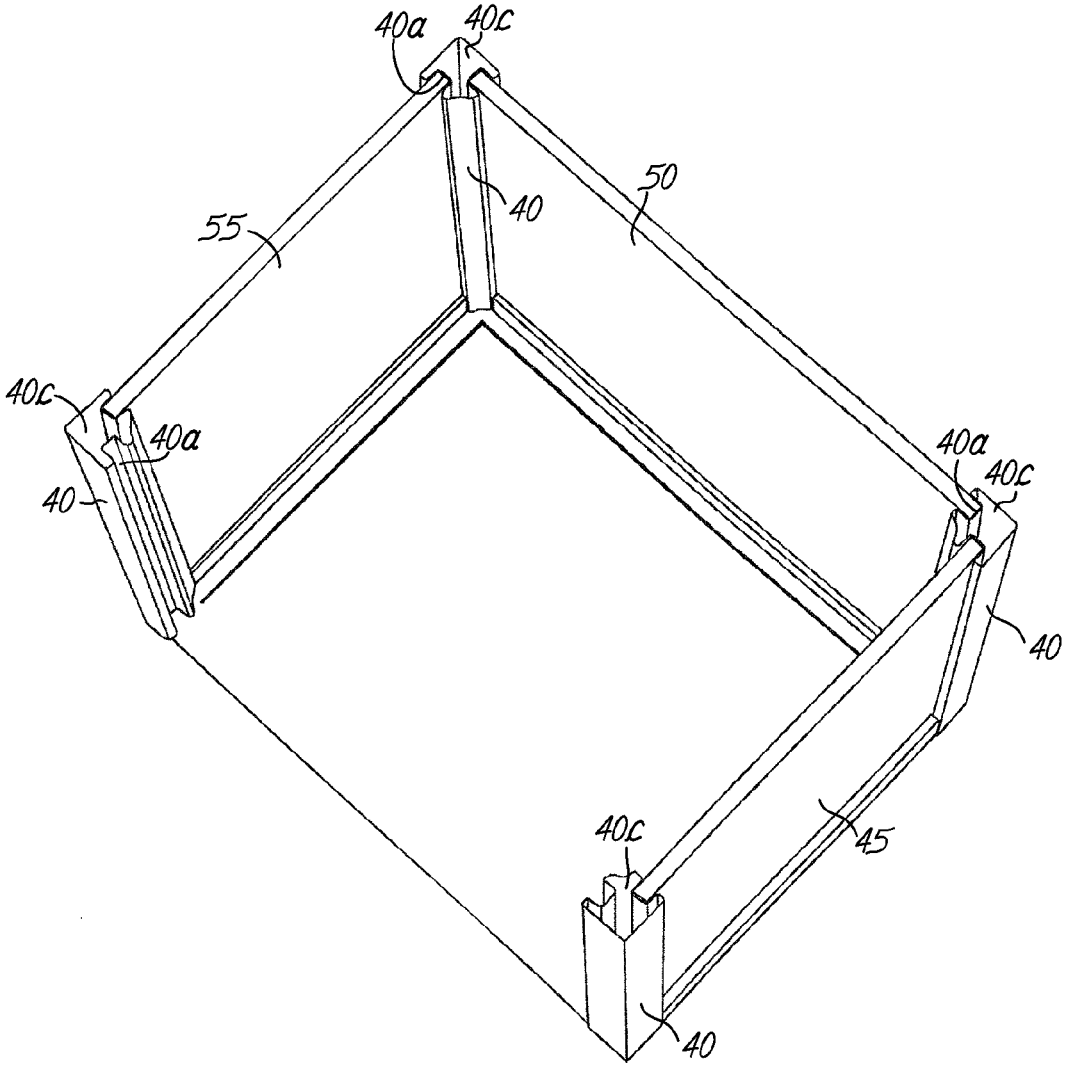
FIG. 6 is a perspective, partially assembled view of the storage cabinet of FIGS. 3 and 4.
Figure 7:
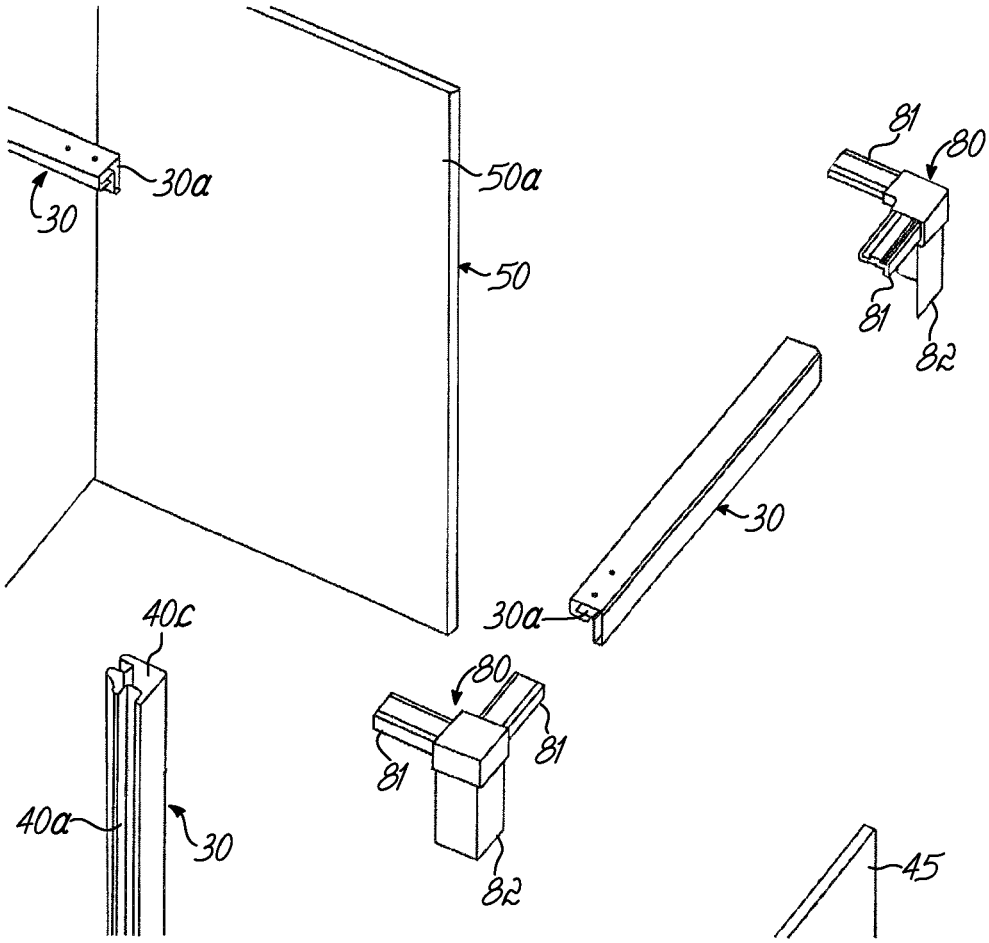
FIG. 7 is an exploded view illustrating various components of the storage cabinet of FIGS. 3, 4, and 6.

With continued reference to FIGS. 2 and 3 and further referring to FIGS. 5, 6, and 7, the posts 40 extend generally from the deck 18, and more specifically from a base platform adjacent the deck 18 of freezer 10. Specifically, each of the posts 40 extends from a base platform defined by respective flat, horizontal surfaces 62*a* of respective post brackets 62 that are, in turn, coupled to a frame 18*a* (FIG. 5) defining deck 18, and which may be made of 14-gauge or lower cold-rolled steel, for example. The post brackets 62 are made of a suitably chosen material, such as, and without limitation, a metal (e.g., aluminum) or plastic, and are securely fastened to the frame 18*a* through one or more fasteners such as socket heads or cork screws 64, for example.

Four generally T-shaped corner brackets 80 are disposed so as to define corners of the cabinet 16 and thereby corners of the freezer 10. The T-shaped brackets 80 provide structural integrity to the cabinet 16 and cooperate with the frame members 30 and posts 40 to further define the rigid framework 12 of freezer 10. More specifically, each of the T-shaped brackets 80 is configured for coupling with a pair of adjacent ones of the insulated panels 45, 50, 55, and with one of the posts 40. To this end, each T-shaped bracket 80 includes a pair of generally horizontally oriented arms 81, generally orthogonal to one another, each shaped and sized so as to be received within a channel 30*a* extending along a longitudinal dimension of each of the frame members 30. Similarly, each T-shaped bracket 80 includes a leg 82 that is sized and shaped to be received within a channel 40*c* extending along a longitudinal dimension of each post 40. The entirety or at least certain portions of one or more of the T-shaped brackets 80 is made of a flexible material capable, for example, of bending so as to facilitate coupling of the T-shaped bracket with the frame members 30 and/or the posts 40. In the illustrated embodiment, for example, the leg 82 of each T-shaped bracket 80 is made of a plastic material that is configured to bend during insertion of leg 82 into the channel 40*c* of each post 40. In addition, each of the T-shaped brackets 80 may include one or more tabs that would be arranged so as to pop into place when suitably engaged with a frame member 30 or a post 40, with such popping locking the frame member 30 or post 40 relative to the T-shaped bracket 80.

Figure 8:
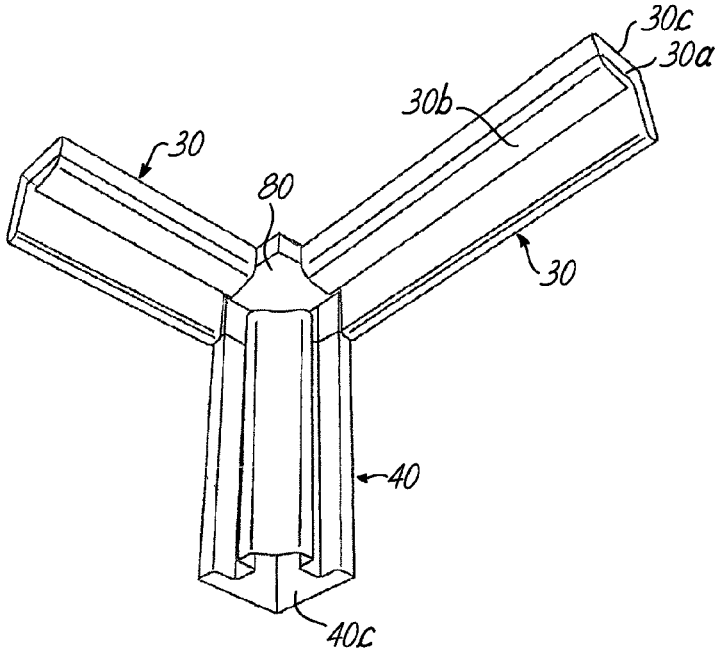
FIG. 8 is a perspective view illustrating construction of a corner of the storage cabinet of FIGS. 3, 4, and 6.
Figure 9:
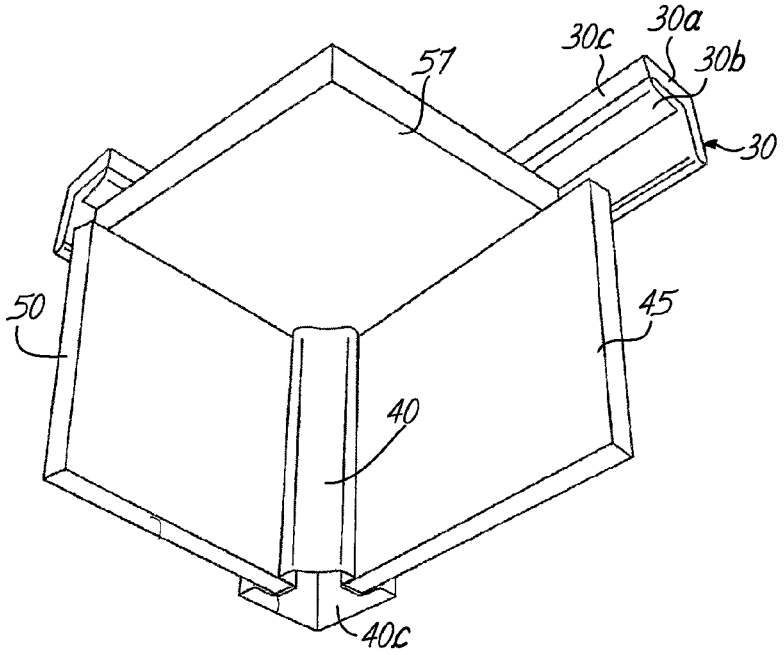
FIG. 9 is a perspective view similar to FIG. 8, additionally illustrating a plurality of insulated panels of the storage cabinet of FIGS. 3, 4, and 6.

With continued reference to FIGS. 2-7, and further referring to FIGS. 8 and 9, coupling between the insulated panels 45, 50, 55, the frame members 30, and the posts 40 in the illustrated embodiment does not require the use of fasteners. To this end, the frame members 30 are designed to facilitate such fastener-free coupling. Specifically, and with particular reference to FIG. 9, each of the frame members 30 includes a resilient flap 30*b* extending from a main portion 30*c* of each of the frame members 30 in a manner so as to leave a gap between the flap 30*b* and the main portion 30*c*. During assembly of cabinet 16, the optional top insulated panel 57 is arranged in an abutting relationship with one or more of the resilient flaps 30*b* such that the resilient flaps 30*b* urge the top panel 57 in a direction toward the side panels 45, 50, 55. Once the cabinet 16 is assembled, each of the resilient flaps 30*b* provides continuous pressure against the top panel 57, which in turn exerts pressure against the corresponding side panels 45, 50, 55. This continuous pressure also provides respective seals between the side panels 45, 50, 55 and the top panel 57, which prevents or minimizes energy loss between the interior 16*a* of cabinet 16 and the surrounding environment. It is also contemplated that, alternatively or additionally, coupling between the insulated panels 45, 50, 55, the frame members 30, and the posts 40 may include fasteners such as screws or bolts (not shown), for example.

With particular reference to FIGS. 6-7, and as discussed above, one or more of the posts 40 includes a channel 40*c* extending along a longitudinal dimension of the post 40. The channels 40*c* may be left empty or be alternatively configured to receive, for example, wiring, insulation, or tubing of the freezer 10 therealong. The channels 40*c* may be used, for example, to receive wiring or tubing connecting the refrigeration system 20 (FIG. 1) supported in the deck 18 to components of the refrigeration system 20 supported in the cabinet 16. For example, and without limitation, the channels 40*c* may receive wiring and/or tubing connecting the components supported in lower deck 18 with an evaporator forming part of a shelf or other portions the interior 16*a* of cabinet 16.

Figure 10:
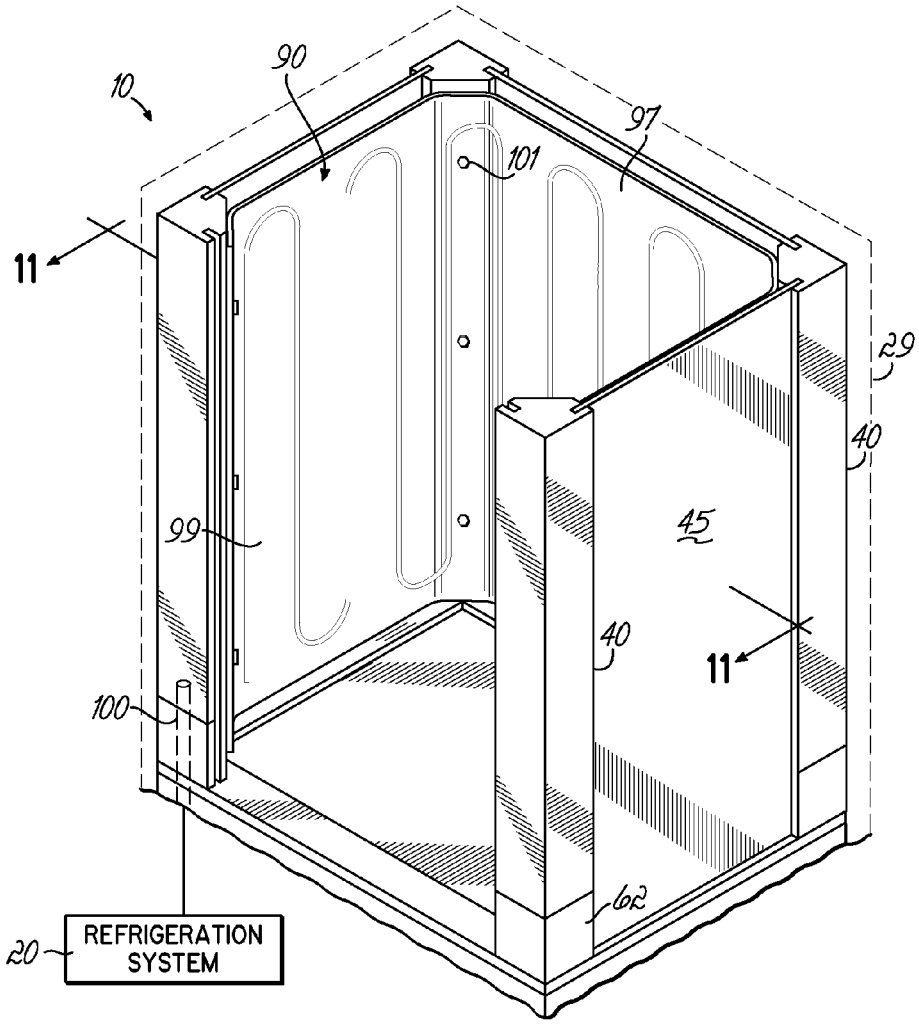
FIG. 10 is a perspective view of the storage cabinet of FIGS. 3, 4, 6, illustrating an evaporator defining an interior of the storage cabinet.
Figure 11:
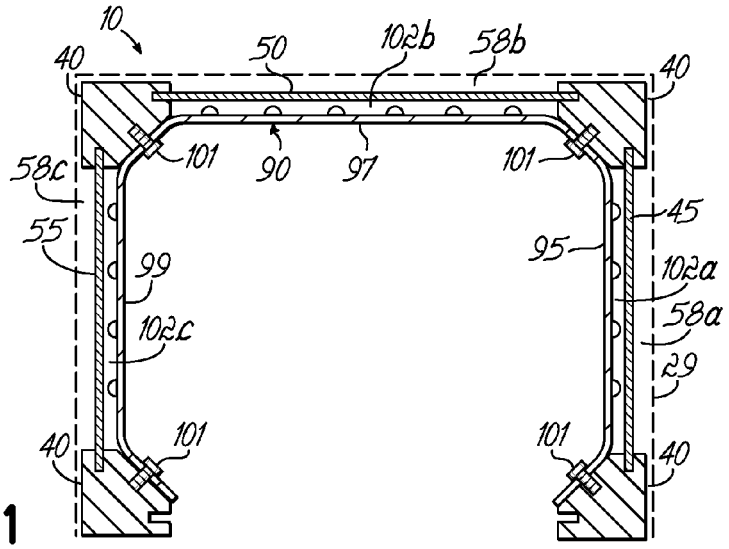
FIG. 11 is a cross-sectional view taken generally along line 11-11 of FIG. 10.

With particular reference to FIGS. 10-11, an exemplary arrangement is illustrated for an evaporator suitable for use with the freezer 10. The exemplary evaporator is in the form of a generally U-shaped roll-bond evaporator 90, having 3 evaporator panels 95, 97, 99 that are disposed in respective parallel orientations with each of the side insulated panels 45, 50, 55. A conduit such as a capillary tube 100 extends within one of the channels 40*c* and communicates the evaporator 90 with other components of the refrigeration system 20 in deck 18. In the illustrated embodiment, each of the evaporator panels 95, 97, 99 is coupled to one or more of the posts 40 via fasteners 101 such as bolts or screws, for example. In the illustrated embodiment, respective volumes 58*a*, 58*b*, 58*c* between the side insulated panels 45, 50, 55 and the optional outer skin 29 is effectively free of expanding, foamed-in-place insulation material, as are respective volumes 102*a*, 102*b*, 102*c* between the side insulated panels 45, 50, 55 and the evaporator panels 95, 97, 99.

Figure 12:
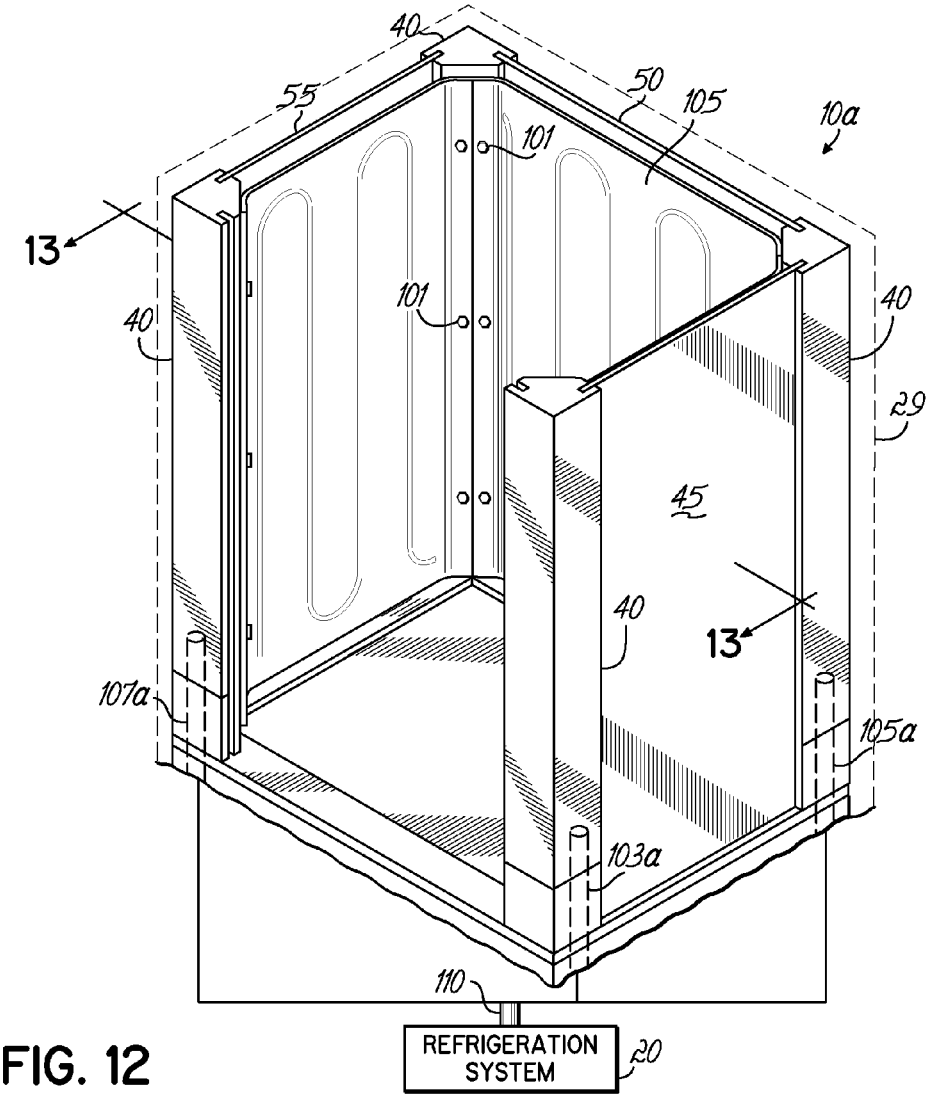
FIG. 12 is a perspective view of a storage cabinet similar to that of FIG. 10, illustrating an evaporator according to a different embodiment of the present invention.
Figure 13:
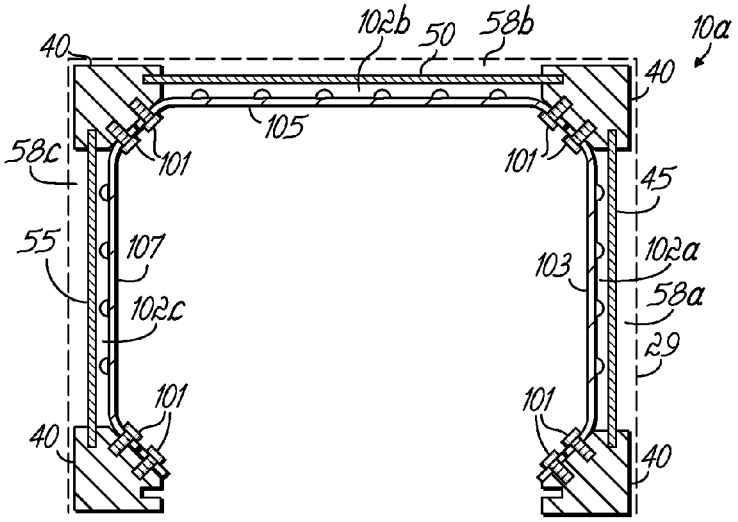
FIG. 13 is a cross-sectional view taken generally along line 12-12 of FIG. 12.

With reference to FIGS. 12-13, another exemplary embodiment of a freezer 10*a* includes 3 generally planar roll-bond evaporators 103, 105, 107 each respectively oriented generally parallel to insulated panels 45, 50, 55 and fluidly communicating with other components of the refrigeration system 20 in deck 18. In this regard, each of the evaporators 103, 105, 107 communicates with each of those other components through respective conduits in the form of capillary tubes 103*a*, 105*a*, 107*a*, for example, each extending within one of the channels 40*c* of respective posts 40. The capillary tubes 103*a*, 105*a*, 107*a* of this embodiment are joined together at a distribution conduit 110 (schematically depicted) that may extend within one of the channels 40*c* or may be alternatively located within deck 18 or at another location of freezer 10*a*. Each of the evaporators 103, 105, 107 is coupled to one or more of the posts 40 via fasteners 101 such as bolts or screws, for example. In the illustrated embodiment, respective volumes 58*a*, 58*b*, 58*c* between the side insulated panels 45, 50, 55 and the optional outer skin 29 is effectively free of expanding, foamed-in-place insulation material, as are respective volumes 102*a*, 102*b*, 102*c* between the side insulated panels 45, 50, 55 and the evaporators 103, 105, 107.

Figure 14:
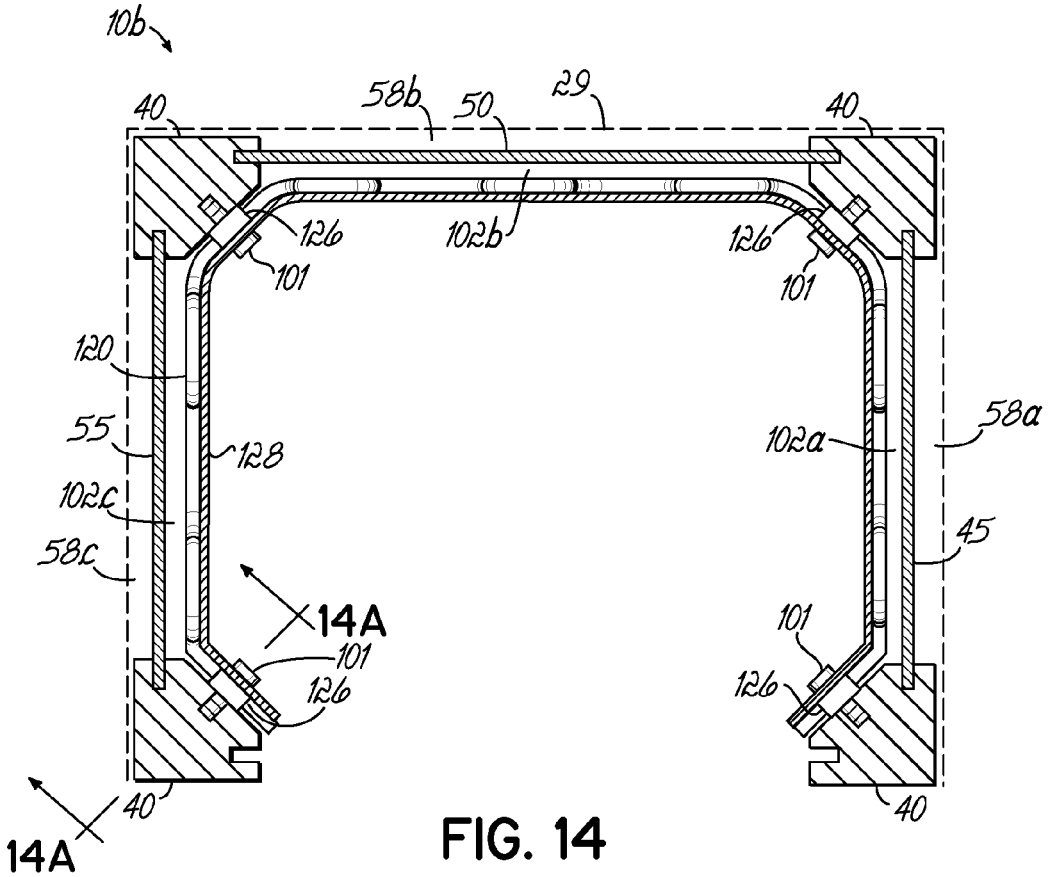
FIG. 14 is a cross-sectional view similar to FIGS. 11 and 13, illustrating an evaporator according to yet another different embodiment of the present invention.
Figure 14A:
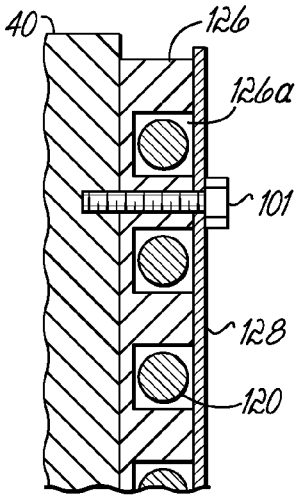
FIG. 14A is a cross-sectional view taken generally along line 14A-14A of FIG. 14.

With reference to FIGS. 14 and 14A, yet another exemplary embodiment of a freezer 10*b* includes an evaporator in the form of a coil 120 (e.g., copper tubing). The coil 120 fluidly communicates with other components of the refrigeration system 20 in deck 18 through a conduit extending within one of the channels 40*c* (FIGS. 6, 8, and 9). The coil 120 is disposed adjacent one or more of the side insulated panels 45, 50, 55 and is coupled (e.g., welded or brazed) to a liner element 128 defining the interior 16*a* of cabinet 16. The liner element 128 is secured to one or more of the posts 40 via fasteners 101 such as bolts or screws, for example. To this end, coupling of the liner element 128 to one or more of the posts 40 includes, in this embodiment, placing a separator or spacer element 126 between the coil 120 and each post 40. More specifically, and with particular reference to FIG. 14A, the coil 120 is received along a plurality of channels 126*a* of each separator element 126 such that the coil 120 is tightly secured between the spacer elements 126 and the liner element 128. In another aspect of the illustrated embodiment, respective volumes 58*a*, 58*b*, 58*c* between the side insulated panels 45, 50, 55 and the optional outer skin 29 is effectively free of expanding, foamed-in-place insulation material, as are respective volumes 102*a*, 102*b*, 102*c* between the side insulated panels 45, 50, 55 and respective side wall portions of the coil 120.

The predetermined lengths of the frame members 30, posts 40, side insulated panels 45, 50, 55, and the optional top insulated panel 57, permit repeatability in the assembly process of freezer 10. Moreover, several of these components may be used across different models of freezers, thereby reducing the required inventory held and maintained in a manufacturing facility. Specifically, for example, two or more different models of freezers may have cabinets 16 of similar heights (arrow 132 of FIG. 2) and thus utilize posts 40 having similar lengths. Additionally or alternatively, two or more different models of freezers may have cabinets 16 of the same depth (arrow 134) and thus have the two frame members 30 defining the depth of the cabinet 16 in common.

What is claimed is:

1. A storage cabinet for an ultra-low temperature freezer having a deck, comprising:

a plurality of side structural insulated panels each defining a side wall of the storage cabinet;

a plurality of generally vertically oriented posts supported by the deck, at least one of the plurality of generally vertically oriented posts having a slot for receiving an edge portion of one of the side insulated panels therealong; and an evaporator mounted so as to confront and be spaced laterally from each of the plurality of side insulated panels by a volume, wherein the volume is effectively free of expanding, foamed-in-place insulation.

2. The storage cabinet of claim 1, wherein the slot has a generally U-shaped profile surrounding the edge portion of the one of the side insulated panels.

3. The storage cabinet of claim 1, further comprising:

an outer skin surrounding the insulated panels and defining an outer surface of the freezer, a volume between the outer skin and the side insulated panels being effectively free of expanding, foamed-in place insulation.

4. The storage cabinet of claim 1, wherein at least one of the generally vertically oriented posts has a channel extending along a longitudinal dimension thereof, the channel being configured to receive one of insulation, tubing, or wiring of the freezer therethrough.

5. The storage cabinet of claim 1, wherein:

the evaporator comprises a roll-bond evaporator adjacent one of the side insulated panels and configured to fluidly communicate with a refrigeration system of the freezer for cooling an interior of the storage cabinet.

6. The storage cabinet of claim 5, wherein the roll-bond evaporator is coupled to one of the generally vertically oriented posts.

7. The storage cabinet of claim 5, wherein the roll-bond evaporator includes a plurality of evaporator panels, each evaporator panel being oriented generally parallel to one of the side insulated panels.

8. The storage cabinet of claim 5, wherein the volume between the roll-bond evaporator and an adjacent side insulated panel is effectively free of expanding, foamed-in place insulation.

9. The storage cabinet of claim 1, wherein:

the evaporator comprises a plurality of roll-bond evaporator panels, each adjacent one of the side insulated panels; and a plurality of capillary tubes each in fluid communication with one of the roll-bond evaporator panels, each of the capillary tubes being configured to fluidly communicate with a refrigeration system of the freezer for cooling an interior of the storage cabinet.

10. The storage cabinet of claim 9, wherein the respective volumes between the roll-bond evaporator panels and the respectively adjacent side insulated panels are effectively free of expanding, foamed-in place insulation.

11. The storage cabinet of claim 1, wherein:

the evaporator comprises an evaporator coil secured to one of the generally vertically oriented posts, the evaporator coil being configured to fluidly communicate with a refrigeration system of the freezer for cooling an interior of the storage cabinet; and a spacer element disposed between the evaporator coil and the one of the generally vertically oriented posts.

12. The storage cabinet of claim 11, wherein the volume between the evaporator coil and an adjacent side insulated panel is effectively free of expanding, foamed-in place insulation.

13. The storage cabinet of claim 11, wherein the spacer element includes a plurality of channels for receiving the evaporator coil therealong.

14. The storage cabinet of claim 1, further comprising:

a plurality of generally horizontally oriented frame members coupled to one or more of the generally vertically oriented posts; and a top structural insulated panel extending between the generally horizontally oriented frame members.

15. The storage cabinet of claim 14, wherein one of the generally horizontally oriented frame members includes a resilient flap, the resilient flap being configured to urge the top insulated panel in a direction toward one of the side insulated panels so as to secure the top and the one of the side insulated panels to one another without the use of fasteners.

16. The storage cabinet of claim 1, wherein at least one of the generally vertically oriented posts has a channel extending along a longitudinal dimension thereof, the cabinet further comprising:

a plurality of T-shaped brackets respectively defining a plurality of corners of the cabinet, at least one of the T-shaped brackets having a leg shaped for insertion into the channel of the at least one of the generally vertically oriented posts.

17. The storage cabinet of claim 16, wherein the leg of the at least one of the T-shaped brackets is made of a flexible material configured to bend during insertion of the leg into the channel of the at least one of the generally vertically oriented posts.

18. The storage cabinet of claim 1, further comprising:

a plurality of generally horizontally oriented frame members; and a plurality of T-shaped brackets respectively defining a plurality of corners of the storage cabinet, at least one of the T-shaped brackets having a generally vertically oriented leg for coupling with one of the generally vertically oriented posts and a pair of generally horizontally oriented arms, each of the arms being configured for coupling with one of the generally horizontally oriented frame members.

19. An ultra-low temperature freezer comprising:

a deck supporting a refrigeration system therein; and a storage cabinet supported above the deck and having an interior cooled by the refrigeration system, the storage cabinet including:

(a) a plurality of side structural insulated panels each defining a side wall of the storage cabinet, (b) a plurality of generally vertically oriented posts supported by the deck, at least one of the plurality of generally vertically oriented posts having a slot for receiving an edge portion of one of the insulated panels therealong, and an evaporator mounted so as to confront and be spaced laterally from each of the plurality of side insulated panels by a volume, wherein the volume is effectively free of expanding, foamed-in-place insulation.

20. The freezer of claim 19, wherein the refrigeration system is a two-stage cascade refrigeration system configured to cool an interior of the storage cabinet, the refrigeration system including a heat exchanger supported within the deck.

21. The freezer of claim 19, wherein the storage cabinet includes an outer skin surrounding the insulated panels and defining an outer surface of the freezer, a volume between the outer skin and the insulated panels being effectively free of expanding, foamed-in place insulation.

22. A method of constructing an ultra-low temperature freezer, comprising:

obtaining a deck;

arranging a plurality of side structural insulated panels so as to define respective walls of a storage cabinet of the freezer;

supporting a plurality of generally vertically oriented posts with the deck;

receiving an edge portion of one of the side insulated panels within a slot extending along a longitudinal dimension of one of the generally vertically oriented posts; and mounting an evaporator so as to confront and be spaced laterally from each of the plurality of side insulated panels by a volume, wherein the volume is effectively free of expanding, foamed-in-place insulation.

23. The method of claim 22, further comprising:

receiving one of insulation, tubing, or wiring of the freezer into a channel extending along a longitudinal dimension of one of the generally vertically oriented posts.

24. The method of claim 22, wherein the evaporator comprises a roll-bond evaporator, further comprising:

mounting the roll-bond evaporator adjacent one of the side insulated panels; and fluidly connecting the roll-bond evaporator with a refrigeration system of the freezer.

25. The method of claim 22, further comprising:

disposing an outer skin around the insulated panels to thereby define an outer surface of the freezer; and leaving a volume between the outer skin and an adjacent side insulated panel effectively free of expanding, foamed-in-place insulation.

26. The method of claim 22, further comprising:

obtaining a top insulated panel;

obtaining a generally horizontally oriented bar having a resilient portion; and arranging the top and side insulated panels such that the resilient portion urges the top insulated panel in a direction toward one of the side insulated panels, the urging being operable to secure the top and side insulated panels relative to one another without the use of fasteners.

27. The method of claim 22, further comprising:

obtaining a bracket to define a corner of the freezer; and bending a leg of the bracket to facilitate insertion thereof into a channel extending along a longitudinal dimension of one of the generally vertically oriented posts.

28. The method of claim 22, further comprising:

obtaining a bracket; and coupling the bracket to one of the generally vertically oriented posts and to a pair of generally horizontally oriented frame members to thereby define a corner of the freezer.

29. The method of claim 22, further comprising:

obtaining a liner element to define an interior of the freezer and an evaporator coil to cool the interior of the freezer;

coupling the liner element to at least one of the generally vertically oriented posts; and disposing a spacer element between the at least one of the generally vertically oriented posts and the evaporator coil so as to secure the evaporator coil to the liner.

30. The method of claim 29, wherein the evaporator comprises an evaporator coil, further comprising:

mounting the evaporator coil within a plurality of channels of the spacer element.

31. The method of claim 22, further comprising:

obtaining a liner element to define an interior of the freezer and an evaporator coil to cool the interior of the freezer; and leaving a volume between the liner element and the insulated panels effectively free of expanding, foamed-in-place insulation.

* * * * *

UNITED STATES PATENT AND TRADEMARK OFFICE

CERTIFICATE OF CORRECTION

PATENT NO. : 8,931,300 B2
APPLICATION NO. : 13/062326
DATED : January 13, 2015
INVENTOR(S) : Dennis H. Smith et al.

It is certified that error appears in the above-identified patent and that said Letters Patent is hereby corrected as shown below:

In the Specification:

In column 1, line 40, change "The cooled, condensed gas, is then allowed" to --The cooled, condensed gas is then allowed--.

In column 1, line 54, change "conventional ULT's may include" to --conventional ULTs may include--.

In column 2, line 1, change "conventional ULT's and conventional construction" to --conventional ULTs and conventional construction--.

In column 4, line 24, change "FIG. 1A is schematic representation" to --FIG. 1A is a schematic representation--.

In column 5, line 29, change "permit controlling of the operation" to --permits controlling of the operation--.

In column 8, line 63, change "or other portions the interior" to --or other portions of the interior--.

In column 9, line 11, change "is effectively free of expanding," to --are effectively free of expanding,--.

In column 9, line 34, change "is effectively free of expanding," to --are effectively free of expanding,--.

In column 9, line 58, change "is effectively free of expanding," to --are effectively free of expanding,--.

Signed and Sealed this
Thirtieth Day of June, 2015

Michelle K. Lee

Michelle K. Lee
*Director of the United States Patent and Trademark Office*

In the Claims:

In claim 3, column 10, line 33, change “foamed-in place insulation.” to --foamed-in-place insulation.--.

In claim 8, column 10, line 53, change “foamed-in place insulation.” to --foamed-in-place insulation.--.

In claim 10, column 10, line 67, change “foamed-in place insulation.” to --foamed-in-place insulation.--.

In claim 12, column 11, line 11, change “foamed-in place insulation.” to --foamed-in-place insulation.--.

In claim 21, column 12, line 11, change “foamed-in place insulation.” to --foamed-in-place insulation.--.